US006631569B1

(12) United States Patent
Scharbius et al.

(10) Patent No.: US 6,631,569 B1
(45) Date of Patent: Oct. 14, 2003

(54) INTERNAL CUSHIONED METATARSAL GUARD FOR SAFETY FOOTWEAR AND METHOD OF MAKING THE SAME

(75) Inventors: David H. Scharbius, Merrill, WI (US); Charles E. Phillips, Gleason, WI (US); Robert J. Krebs, St. Charles, MO (US); Linda M. Herber, Tomahawk, WI (US); David A. Kucirek, Merrill, WI (US); Daniel D. Szulczewski, Merrill, WI (US); Lance R. Nienow, Merrill, WI (US)

(73) Assignee: Weinbrenner Shoe Company, Inc., Merrill, WI (US)

( * ) Notice: Subject to any disclaimer, the term of this patent is extended or adjusted under 35 U.S.C. 154(b) by 0 days.

(21) Appl. No.: 09/691,696

(22) Filed: Oct. 18, 2000

Related U.S. Application Data

(60) Provisional application No. 60/159,994, filed on Oct. 18, 1999.

(51) Int. Cl.[7] ..... A43B 7/14; A43B 23/00

(52) U.S. Cl. ..... 36/72 R; 36/96; 36/136

(58) Field of Search ..... 36/96, 136, 77 R, 36/71, 72 R, 72 A

(56) References Cited

U.S. PATENT DOCUMENTS

| | | | | | |
|---|---|---|---|---|---|
| 2,915,837 | A | * | 12/1959 | Schlecht | 36/72 R |
| RE24,897 | E | * | 11/1960 | Schlecht | 36/72 R |
| 2,972,824 | A | * | 2/1961 | Schlecht | 36/72 R |
| 2,988,829 | A | * | 6/1961 | Johnsen | 36/72 R |
| 3,101,559 | A | * | 8/1963 | Smith | 36/72 R |
| 3,206,874 | A | * | 9/1965 | Ellis et al. | 36/72 R |
| 3,805,419 | A | * | 4/1974 | White | 36/77 R |
| 3,995,382 | A | | 12/1976 | Smith | |
| 4,102,062 | A | | 7/1978 | Adams | |
| 4,342,159 | A | | 8/1982 | Edwards | |
| 4,366,629 | A | | 1/1983 | Scherz | |
| 4,803,989 | A | | 2/1989 | Collins | |
| 4,908,963 | A | * | 3/1990 | Krajcir et al. | 36/72 R |
| 5,457,898 | A | | 10/1995 | Fortin et al. | |
| 5,701,688 | A | * | 12/1997 | Crowley | 36/72 R |
| 5,765,297 | A | * | 6/1998 | Cooper et al. | 36/72 R |
| 5,878,511 | A | | 3/1999 | Krajcir | |
| 6,161,313 | A | * | 12/2000 | Bisson | 36/72 R |

OTHER PUBLICATIONS

Meta–Tec Brochure, Esjot Goldenberg, BS EN.

Iron Age 1997 Industrial Footwear Catalog, p. 30, Model Nos. 446, 448, 464; pp. 68–70, Model Nos. 250, 252, 254, 256, 258, 570, 572, 652; pp. 74–76, Model Nos. 246, 248, 555, 647, 259, 567, 669; pp. 78–79, Model Nos. 980, 989, 998, 973, 975, 986.

* cited by examiner

*Primary Examiner*—Anthony D. Stashick
(74) *Attorney, Agent, or Firm*—Reinhart Boerner Van Deuren s.c.

(57) ABSTRACT

An improved safety boot or shoe is disclosed which integrally incorporates a cushioned metatarsal guard to protect the metatarsal region of the wearer's foot from injury caused by objects falling onto this region of the wearer's foot. The metatarsal guard is be assembled from different segments of materials in consecutive layer fashion, and in the preferred embodiment includes a segment of impact cushion material, a segment of cut-resistant material, a segment of force absorption material, and a segment of in-step cushion material. The segments are preferably adhesively affixed together to form a sandwich, with the sandwich then being interposed between the interior of the upper and the inner lining of the safety boot or shoe. In the preferred embodiment, a rigid toe is also included, with a portion of the metatarsal guard of the present invention overlying a portion of the rigid toe.

34 Claims, 4 Drawing Sheets

INTERNAL CUSHIONED METATARSAL GUARD FOR SAFETY FOOTWEAR AND METHOD OF MAKING THE SAME

"This Application claims the benefit of U.S. Provisional Application No. 60/159,994 filed Oct. 18, 1999. "

BACKGROUND OF THE INVENTION

FIELD OF THE INVENTION

The present invention relates generally to safety footwear, and more particularly, to safety boots and shoes that integrally incorporate a cushioned metatarsal guard protecting the metatarsal region (the instep region) of the wearer's foot from injury caused by objects falling onto this region of the wearer's foot.

The metatarsal region or in-step of the human foot extends forwardly from the ankle to the base of the toes and contains a number of elongated bones extending side by side. The in-step of the foot is particularly vulnerable to impact and crushing forces, especially those caused by falling or dropped objects. This region of the foot may also be injured by laceration or ,puncture by pointed objects or sharp edges encountered in industrial operations. Yearly, over 120,000 people are injured in such accidents. The American National Standards Institute ("ANSI") has developed a standard for footwear manufacturers to follow to ensure proper foot protection. The current standard is the ANSI Z41-1999 standard, which is approved by the Occupational Safety and Health Administration (OSHA). A certification under this standard for personal protective equipment including safety footwear is necessary to obtain consumer acceptance.

Footwear manufacturers have manufactured boots and shoes with a variety of metatarsal guards and cushions in an attempt to prevent the injuries described above. The most common method of protecting the metatarsal region is by placing a tough, rigid, synthetic plastic or metal shield over the exterior of the shoe to cover the metatarsal region of the foot. One example of such a shield is illustrated in U.S. Pat. No. 3,995,382, to Smith. This method of protecting the metatarsal region creates an unsightly and clumsy appearance of the shoe. Furthermore, the rigid shield limits the range of motion of the foot during walking or running. The external metatarsal shield also pinches the ankle when bending or squatting. More importantly, this type of metatarsal shield creates a snagging and tripping hazard which could cause extreme injury. The disadvantages described above create an uncomfortable safety shoe that most people do not like to wear.

Others have incorporated the rigid synthetic plastic or metal metatarsal shield into a fabric or leather cover usually matching the material the footwear is made from. This covered shield is then attached to the toe of the boot. In effect, the metatarsal shield becomes a second tongue placed over the exterior of the safety boot. This external shield does not solve the problems mentioned above which are associated with the uncovered, external metatarsal protectors. The shoes remain bulky and clumsy in appearance. Furthermore, the metatarsal protectors continue to be rigid, which prevents a full range of foot motion and results in fewer individuals wearing such protective equipment. Lastly, these types of metatarsal guards continue to present a tripping and snagging hazard.

In an attempt to create a more aesthetically pleasing and comfortable safety boot that minimizes the tripping and snagging hazard presented by external metatarsal shields, manufacturers have experimented with integrating metatarsal protectors into a boot. U.S. Pat. No. 4,102,062, to Adams, discloses a metatarsal protector made from rigid synthetic plastic material that is incorporated integrally into the boot. This method of protecting the metatarsal region continues to prevent the wearer of the boot from walking freely, and limits the range of motion of the foot because the rigid synthetic plastic material cannot bend or flex with the contours of the foot during walking or running. Because such safety boots cannot bend or flex properly, and are therefore uncomfortable, individuals are deterred from wearing such footwear. Furthermore, the integrated metatarsal protectors are not cushioned properly to prevent at least some pinching and other stresses from being inflicted on the metatarsal region of the foot.

The evolution of metatarsal guards has been advanced by others who have integrated hinged metal or plastic metatarsal guards into the safety footwear. Small pieces of metal or plastic are interlocked and riveted together to provide a flexible structure similar to linked armor of the middle ages. Because the separate pieces are overlapped and hinged together, the wearer's foot is often pinched between the movable parts. Additionally, these types of guards have been found not to adequately distribute the impact forces of falling objects, which may thus result in point of contact injuries. Furthermore, upon impact forces or over time, the metal or plastic sections and the rivets can break loose. This can cause the safety footwear to become unwearable, or even worse, can seriously injure the wearer's foot. As with other metatarsal protectors, this type of metatarsal guard creates an uncomfortable shoe that people do not want to wear.

To overcome the problems and disadvantages associated with the prior art, it is a primary objective of the present invention that it protect the metatarsal region of the foot from impacts or blows resulting from falling objects, as well as punctures and cuts from sharp objects encountered in the everyday workplace. This objective must be accomplished by meeting or exceeding the ANSI Z41-1999 standard. It is a further objective of the present invention that the guard be of a flexible nature to allow a full range of motion of the foot, which will provide the wearer with a boot or shoe that allows and conforms with natural walking or running movements. Furthermore, the guard of the present invention must be integrally positioned within the footwear to create an aesthetically pleasing appearance.

It is another objective of the guard of the present invention that it be light-weight and comfortable. It must be light enough so as to not fatigue the wearer. The guard of the present invention must also be flexible, with non-moving parts so as to prevent any pinching, cutting, or other irritation of the wearer's foot.

It is yet a further objective of the present invention that it fully and completely protect the wearer's foot from impact, puncture, cutting or blows to the metatarsal region and extending to the toes. The guard of the present invention, when used in conjunction with a protective toe cover such as a steel toe, must extend up to or beyond the protective toe cover to protect the entire metatarsal region of the foot. The guard of the present invention must also be able to withstand puncture or cutting caused by sharp objects or sharp points from objects. Additionally, the guard of the present invention must act to transfer and disperse impact forces from the region of impact to a broader region, thereby distributing the force. This will prevent a direct, single concentrated source of energy from the impact or blow, and prevent point-of-impact injuries to the wearer's foot.

The guard of the present invention must also be of construction which is both durable and long-lasting, and it should require little or no maintenance to be provided by the user throughout its operating lifetime. In order to enhance the market appeal of a boot or shoe incorporating the guard of the present invention, it should also be of inexpensive construction to thereby afford at the broadest possible market. Finally, it is also an objective that all of the aforesaid advantages and objectives be achieved without incurring any substantial relative disadvantage.

SUMMARY OF THE INVENTION

The disadvantages and limitations of the background art discussed above are overcome by the present invention.

The present invention provides a safety boot or shoe with a cushioned metatarsal guard designed to protect the metatarsal region of a wearer's foot from falling objects. In accordance with one aspect of the invention, a sole with a top surface and a bottom surface can be joined to an upper by stitching, adhesive, or a combination of both to form a cavity to accommodate the wearer's foot. The upper has an exterior surface exposed to the elements and an interior surface facing towards the cavity. An inner lining may be attached to the interior surface of the upper by either stitching, adhesive, or a combination of both, and the inner lining may be made from leather, cotton, cambrelle, vinyl, polypropylene, tricot and velour or similar fabrics known by those skilled in the art.

When the inner lining is attached to the interior of the upper, a void is formed between the inner lining and the interior of the upper. The size and position of the void may vary depending on how and where the inner lining is attached to the upper. In accordance with an aspect of the present invention, the void can be positioned at the vamp, or otherwise known as the in-step region of the upper located above the metatarsal region of the wearer's foot when placed into the cavity. An insert or metatarsal guard may then be placed into the void between the interior surface of the upper and the inner lining so that it sits above the metatarsal region of the wearer's foot, thereby protecting it from falling objects.

The metatarsal guard in accordance with one aspect of the present invention can be a sandwich structure made up of different segments of materials layered over one another. The first layer may be a segment of cut-resistant material layer that is a flexible, thin, and lightweight fabric material, which can withstand protrusions, punctures, cuts and slices from sharp objects thereby protecting the wearer's foot. DuPont manufactures an example of such a material under its trademark KEVLAR, although other types of fabrics are known by those skilled in the art.

The next layer may be a segment of force absorption material that can absorb and distribute an impact force from a falling object throughout the metatarsal guard. The force absorption material may have a plurality of air pockets to help absorb and distribute such forces, although the air pockets are not necessary to achieve the advantages of the present invention. Additionally, there may be more than one force absorption layer to absorb any impact forces. An example of a force absorption material is a two-part rubber based material with air pockets distributed throughout the material, similar to that manufactured by Esjot Goldenberg of Germany under its trademark META-TEC. Although this material is described herein, other force absorption materials known by those skilled in the art may also be used to substantially perform the same function.

The final layer of the sandwich forming the metatarsal guard may be an in-step cushion material that is lightweight, thin, and flexible. The in-step cushion should be of a pliable nature to accommodate the contours of the wearer's foot. To meet these characteristics, the in-step cushion should be a urethane based foam, polyethylene, EVA or any other type of material known to provide both cushioning and shock absorption. The in-step cushion material covers the irregularities of the interior surface of the upper and the metatarsal guard to provide a uniform surface for the metatarsal region of the wearer's foot resulting in additional comfort. Furthermore, the in-step cushion can absorb any impact forces dispersed from the force absorption material.

In accordance with another aspect of the present invention, the metatarsal guard can also include an impact cushion to absorb forces from falling objects and help define the shape of the metatarsal guard. The impact cushion should rest over the cut-resistant material so as to define the overall shape of the metatarsal guard, and can be made from a cross-linked polyethylene or other similar material known by those skilled in the art.

In accordance with a further aspect of the invention, the different layers of material forming the sandwich structure of the metatarsal guard can be affixed to one another by use of adhesives such as a rubber-based adhesive, double-sided tape, or a thin membrane with adhesive on both sides thereof which, until use, is covered with segments of release paper. The different segments of materials can be affixed to prevent any shifting or moving during use. The adhesive can be applied to a segment of cut-resistant material and affixed to the segment of force absorption material. The same or different adhesive may be applied between the force absorption material layer and the in-step cushion to affix the two segments together to form the metatarsal guard.

Should an impact cushion be used, the adhesive can affix the impact cushion to the cut-resistant material. Although the different layers of materials are described as being affixed to one another, it is apparent to one of ordinary skill in the art to omit using an adhesive to bind the materials together. Additionally, the order of materials comprising the metatarsal cushion can vary depending on manufacturing capabilities and preference.

The metatarsal guard as finally assembled may be secured within the safety shoe or boot by stitching that holds the metatarsal guard in place by joining the inner lining to the upper adjacent to and surrounding the metatarsal guard. The stitching then encloses the metatarsal guard within the void so it cannot shift or move during use. In accordance with other embodiments of the present invention, the metatarsal guard my be held to the inner lining by an adhesive such as a cloth tape, vinyl tape, or any other types of tapes or adhesives, or by a combination of stitching and adhesive materials. By securing the metatarsal guard to the inner lining, the metatarsal guard cannot shift or move during use.

The safety shoe or boot should have a rigid toe protector built into the shoe between the sole and the interior surface of the upper. The rigid toe protector has a cap or top portion in close adjacent to the interior surface of the upper and intermediate the inner lining and the interior surface of the upper. The rigid toe protector also has sidewalls that extend laterally downwards from the cap and are in substantial abutment with the sole. The rigid toe material may be made from such materials as tough plastic, steel, or other materials known to withstand impact forces. The metatarsal guard can overlay the rigid toe protector and in accordance with another embodiment of this invention, be adhesively attached to the rigid toe protector.

In accordance with a different aspect of the present invention, a method of making a cushioned, flexible metatarsal guard for use in safety footwear can include attaching an inner lining to an upper so that a void is formed between the two materials. The inner lining can be attached by stitching, adhesives, or a combination of both. The upper has an interior surface and an in-step or vamp region that covers the metatarsal region of a wearer's foot. The void should be located near the in-step region of the upper. The upper should then be joined with a sole to form a cavity that will accommodate the wearer's foot.

A metatarsal guard can then be assembled from different segments of materials in consecutive layer fashion. The first segment of material, the impact cushion, may be affixed to a segment of cut-resistant material by an adhesive, which may include a mixed rubber-based adhesive, double side tape, cloth tape or the like. The impact cushion can provide both impact absorption and shape to the metatarsal guard. A material such as cross-linked polyethylene foam material can be used, although it would be obvious by someone of ordinary skill in the art to use another type of material. The cut-resistant material protects the wearer's foot from lacerations. Such a material should be thin, flexible and lightweight and should resemble the characteristics of a DuPont material marketed under the trademark KEVLAR.

Next, a segment of force absorption material can be affixed to the segment of cut-resistant material by an adhesive to form the metatarsal guard. The force absorption material should absorb and disperse the impact forces of falling objects. Rubber-based materials can be used including latex or rubber foam, vinyl, or other types of force absorbing materials known by those skilled in the art. An example of such a material is marketed under the trademark META-TEC by Esjot Goldenberg of Germany. An in-step cushion made from a urethane foam material, EVA, or other similar material may also be affixed to the force absorption layer by the same method to provide the wearer with additional comfort and shock absorption.

Finally, the metatarsal cushion can be inserted into the void between the upper and the inner lining to protect the wearer's foot from falling or rolling objects. As discussed herein, the void should be positioned near the in-step region of the upper to protect the metatarsal region of the wearer's foot. The metatarsal cushion should also be affixed to the inner lining to prevent the metatarsal guard from shifting or moving during use. This can be accomplished by affixing the metatarsal guard to the inner lining with an adhesive, such as adhesive tape or the like. The metatarsal guard can also be retained within the void by stitching the inner lining to the upper immediately surrounding the metatarsal guard. This will also prevent the metatarsal guard from shifting or moving during use. Although these two methods are described herein, it is obvious to those skilled in the art to use other methods to secure the metatarsal guard in place.

This invention overcomes the problems and disadvantages associated with the prior art by protecting the metatarsal region of the foot from impacts or blows, as well as from punctures and cuts, resulting from falling or rolling objects encountered in the everyday workplace. The present invention also meets or exceeds the ANSI Z41-1999 standard while providing a metatarsal guard that is of a flexible nature to allow a full range of motion of the foot, which will provide the wearer with a boot or shoe that allows and conforms with natural walking or running movements. Furthermore, the guard of the present invention is integrally positioned within the footwear to create an aesthetically pleasing appearance.

Additionally, the guard of the present invention is lightweight and comfortable to prevent fatigue of the wearer. The guard of the present invention is flexible, with non-moving parts so as to prevent any pinching, cutting, or other irritation of the wearer's foot. Further, the metatarsal guard is located within the shoe or boot to eliminate the guard as a tripping or snagging hazard.

Furthermore, the present invention fully and completely protects the wearer's foot from impact, cutting, puncture, or other blows to the metatarsal region and extending to the toes. The guard of the present invention, when used in conjunction with a protective toe cover such as a steel toe, extends up to or beyond the protective toe cover to protect the entire metatarsal region of the foot. The guard of the present invention also can withstand cutting caused by sharp objects or sharp points from objects. Additionally, the guard of the present invention acts to transfer and disperse impact forces from the region of impact to a broader region, thereby distributing the force and preventing point-of-impact injuries from a direct, single concentrated source of energy.

The guard of the present invention is also of a construction which is both durable and long-lasting, and it should require little or no maintenance by the user throughout its operating lifetime. The present invention is also of inexpensive construction to thereby afford at the broadest possible market.

Finally, all of the aforesaid advantages and objectives are achieved without incurring any substantial relative disadvantage.

DESCRIPTION OF THE DRAWINGS

These and other advantages of the present invention are best understood with reference to the drawings, in which.

DETAILED DESCRIPTION OF THE PREFERRED EMBODIMENT

Figure 1:
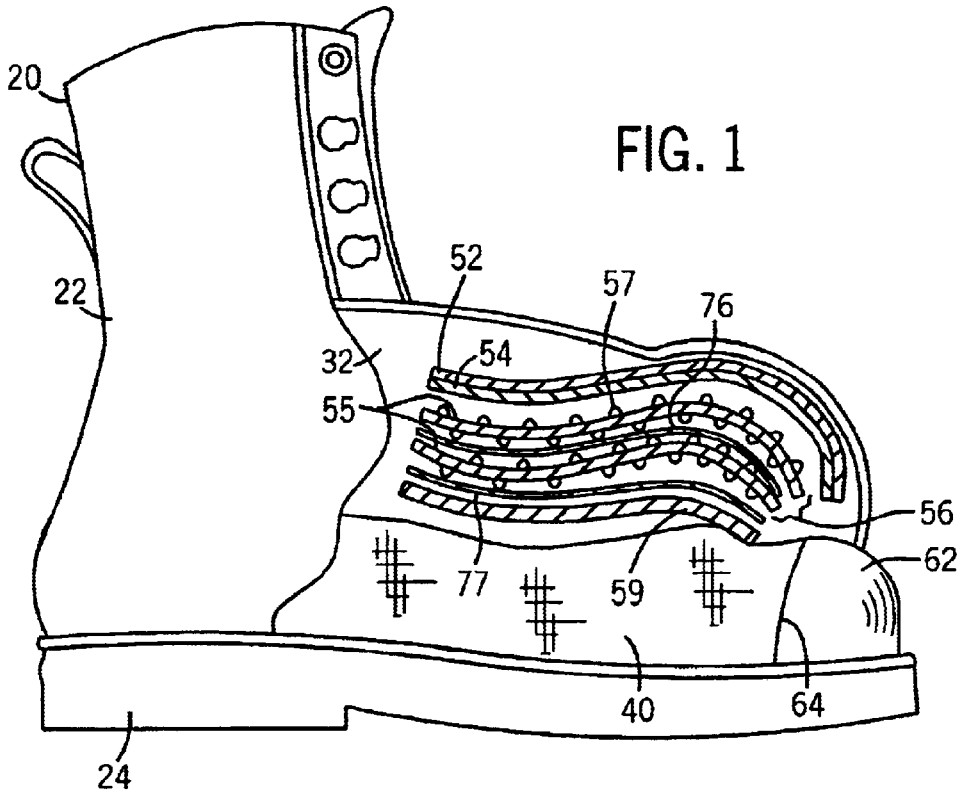
FIG. 1 is a cut-away view of a safety boot according to the teachings of the present invention illustrating the portions of the safety boot as well as the layers of the metatarsal guard.

The preferred embodiment of the present invention incorporates a flexible, cushioned metatarsal guard 50 integrally into a safety boot 20 (although a shoe or any other type of safety footwear may be used). Prior to a discussion of the components of the present invention, it will be helpful to first discuss those well-known elements of the safety boot 20 with respect to FIGS. 1, 2, 4, and 5. The safety boot 20 has an upper 22 attached to a sole. The upper 22 includes a tongue 26 and a vamp or an in-step region 28 and is usually made from leather, but may instead be fabricated from most any material known by those skilled in the art, including natural and synthetic fibers and materials.

Additionally, the upper 22 has both an exterior and an interior surface and a toe region 34. The sole has both an outsole 24 and an insole 25 and, like the upper 22, includes a toe region 27. Those of ordinary skill in the art will appreciate that soles for safety footwear may also include other structural elements such as a midsole, a steel plate to prevent punctures, and cushions (none of which are illustrated in FIG. 1–5).

Figure 5:
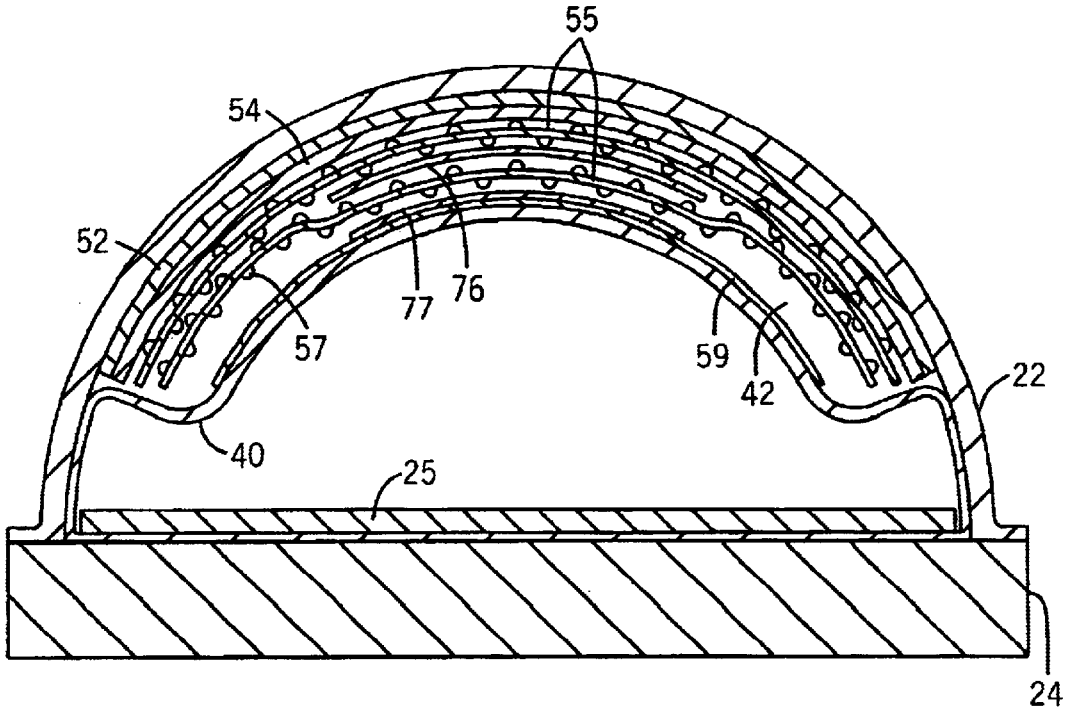
FIG. 5 is a cross-sectional view of the safety boot as illustrated in FIG. 1 displaying the portions of the safety boot and the metatarsal guard.

An inner lining 40 can be attached to the interior 32 of the upper 22 and the insole 25. Stitching is generally used to attach the inner lining 40 to the upper 22. However, an adhesive may also be used to attach the inner lining 40 to the insole 25. The stitching or adhesive may be used either alone or in conjunction with each other to provide a more well-built safety boot. As best shown in FIG. 1 and 5, the inner lining 40 covers the interior surface 32 of the upper 22 and can be attached by those methods described herein.

The inner lining 40 can also cover a rigid toe protector 60 placed near the toe region 34 of the upper 22 and the toe region 27 of the insole 25 between the interior surface of the upper 22 and the insole 25. FIG. 1 most clearly shows the toe protector 60 which has a generally U-shaped cross-sectional configuration having a toe portion or cap 62 and sidewalls 64. The cap 62 lies adjacent to the interior surface of the upper's toe region 34. The sidewalls 64, which constitute substantially perpendicular sides of the toe protector 60, extend downwardly and are immediately adjacent to the outsole 24. This allows any impact forces to be transferred from the toe protector 60 to the outsole 24, and ultimately, to the ground.

The rigid toe protector 60 is convex towards the interior surface of the upper 22 to form a space for the wearer's toes and conform to the general shape of the toe region 34. Typically the toe protector 60 is made from steel, but it may also be manufactured from synthetic polymers such as ABS plastic or other rigid materials known by those skilled in the art to be capable of withstanding impact forces from falling, rolling or static objects. The inner lining 40 can be attached to the underside portion of the cap 62 facing the insole 25 by the adhesive as well.

Figure 4:
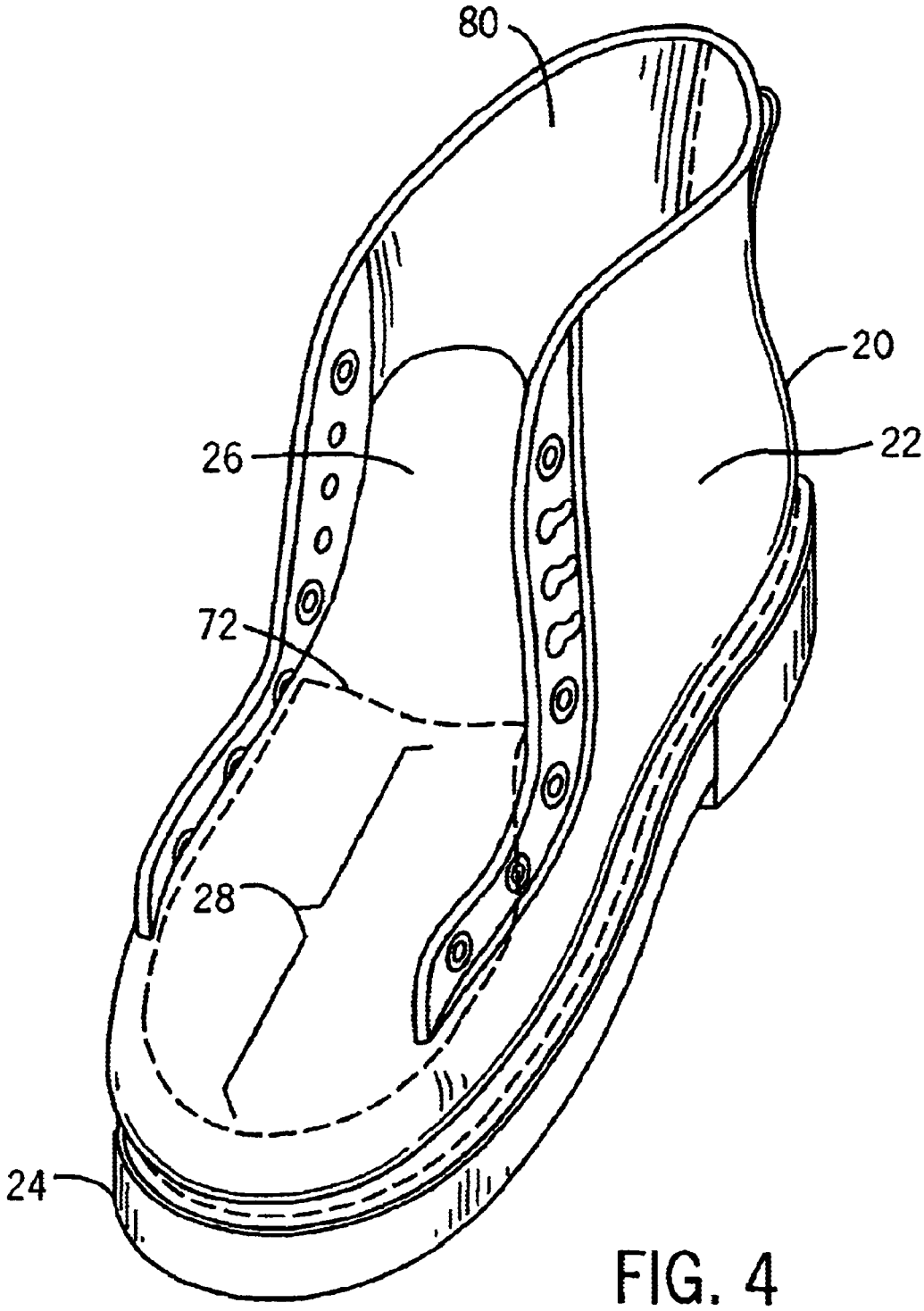
FIG. 4 is an isometric view of the safety boot from an elevated position according to the teachings of the present invention illustrating the portions of the safety boot.

The components which have been discussed to this point are presently known in safety boot construction; however, the present invention includes additional components and features and advantages not apparent or known to those of ordinary skill in the art. These advantages and features are set forth herein. The inner lining 40 and the interior surface of the upper 22 are adjacent to one another and a void 42 is formed between the inner lining 40 and the interior surface of the upper 22. The void 42 is positioned at the vamp or in-step region 28 as best illustrated in FIG. 4, and extends from the toe region 34 to the tongue region 26.

A metatarsal guard 50 rests inside the void 42 and covers the in-step region of the wearer's foot, extending forwardly from the ankle to the rigid toe protector 60. The metatarsal guard 50 overlaps the toe protector 60 so that it is in part adjacent to and interposed between the interior surface of the upper 22 and the cap 62 of the toe protector 60. The metatarsal guard 50 can be affixed to the rigid toe protector 60 by use of an adhesive, or, alternately, it can remain free. In this embodiment, a wearer would not be able to feel the edges of the metatarsal guard 50 while wearing the safety boots 20.

Figure 2:
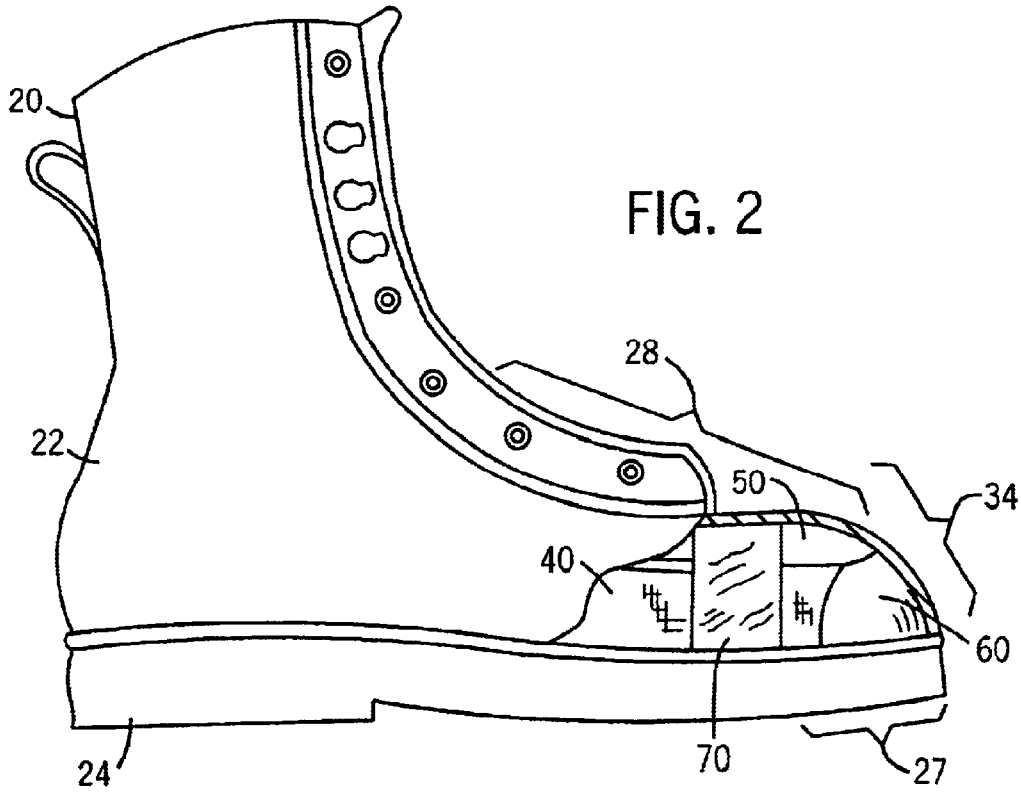
FIG. 2 is a cut-away view of the safety boot as illustrated in FIG. 1 showing the metatarsal guard inserted into the safety boot in final form in accordance with the teachings of the present invention.

As best shown in FIG. 2, the metatarsal guard 50 can also extend laterally downwards towards the outsole 24 along both sides of the wearer's foot between the inner lining 40 and the upper 22. In the preferred embodiment of the present invention, the metatarsal guard 50 does not fully reach the insole 25 on either side of the safety boot 20; however, it would be obvious to one skilled in the art to extend it further downwardly so as to be in substantial abutment with the insole 25.

Upon inserting the metatarsal guard 50 into the void 42 between the inner lining 40 and the upper 22, the upper 22 is joined to the outsole 24, usually by stitching, or by a combination of stitching and adhesives. Other methods of joining the upper 22 to the outsole 24 are well known by those skilled in the art. After joining the outsole 24 and the upper 22, an interior cavity 80 as best shown in FIG. 4 is created in which a wearer's foot is placed.

FIG. 5 illustrates the metatarsal guard 50 integrally placed into the void 42 to protect the metatarsal region or in-step of the wearer's foot. In the preferred embodiment of the present invention, the metatarsal guard 50 extends from its position overlying the rigid toe protector 60 toward the wearer's ankle, and is located under the front portion of the tongue 26 at the in-step region 28 as best shown in FIG. 4. The metatarsal guard 50 can be held in place by stitching 72 between the toe region of the upper 34 and the toe region of the inner lining 40 which encloses the metatarsal guard 50 in the void 42 and holds the metatarsal guard 50 in place. FIG. 2 displays another embodiment of the present invention that utilizes a segment of adhesive tape 70 to hold the metatarsal guard 50 against the inner lining 40 to prevent the metatarsal guard 50 from shifting or moving during use of the safety boot 20. The adhesive tape 70 may be a cloth tape, a vinyl tape, or other appropriate types of tape known by those in the shoe industry. The stitching 72 and adhesive tape 70 may also be used in combination with another.

Figure 3:
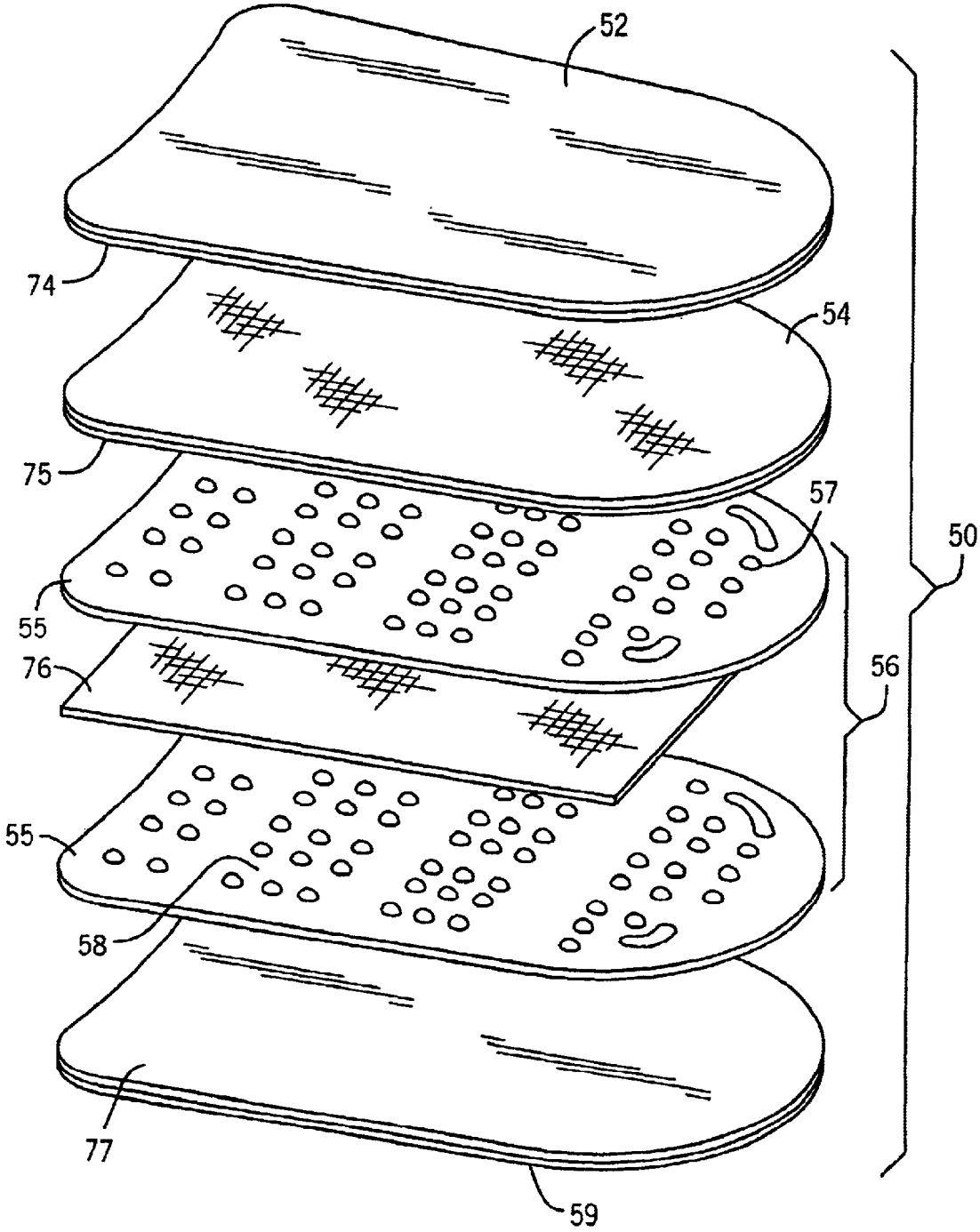
FIG. 3 is an exploded view of a metatarsal guard according to the teachings of the present invention.

FIG. 3 illustrates the metatarsal guard 50, which is a flexible sandwich of several materials which can bend to accommodate the natural movement of a foot. The metatarsal guard 50 is constructed from several layers of materials which are superimposed on one another, and which will be discussed in consecutive order from the top of the metatarsal guard 50 to its bottom.

The first layer of the metatarsal guard 50 is an impact cushion 52. In the preferred embodiment of the present invention, the impact cushion 52 is made of a cross-linked polyethylene foam material that absorbs the impact forces of falling or rolling objects and retains the shape of the in-step region 28 of the upper 22. Shape retention characteristics are commonly referred to by those of ordinary skill in the art as "shadowing." Although a polyethylene foam layer is described herein, it would be apparent to one of ordinary skill in the art to substitute other materials that provide the requisite cushion and/or shadowing in safety boots.

The next layer of the metatarsal guard 50 used in the preferred embodiment of the present invention is a layer made of a cut-resistant material 54. This cut-resistant material 54 is preferably a light weight, highly flexible fabric having excellent resistance to cuts and protrusion, such as, for example, a fabric woven from fibers consisting of long molecular chains produced from poly-paraphenylene terephthalamide, such as the material marketed by E.I. du Pont De Nemours & Co. under the trademark KEVLAR. However, other cut-resistant materials having light weight and excellent strength known by those skilled in the art can also be used.

The metatarsal guard 50 next includes a force absorption material layer 56, which will absorb the impact force caused by falling or rolling objects and disperse it throughout a broader area of the metatarsal guard 50. An example of such a force absorption material 56 which is used in the preferred embodiment is a two-part rubber material manufactured by Esjot Goldenberg of Ense, Germany under the trademark META-TEC. The force absorption material 56 consists of two rubber portions 55 which are closely adjacent to one another, and which each include several air pockets 57 that absorb and disperse any impact force. The force is also absorbed by channels 58 formed by rows of different air pockets 57. By channeling forces away from the direct point of impact, injuries to the metatarsal region (or in-step region) may be reduced. Other embodiments of the present invention may utilize different force absorption materials known to those skilled in the art. Furthermore, it would be obvious to include either a single force absorption layer and/or several force absorption layers in the metatarsal guard 50.

The final layer of the metatarsal guard 50 is an in-step cushion 59. The in-step cushion 59 is preferably a lightweight, padded, and pliable cushion that can absorb impact forces. An example of such a material is a foam cellular urethane manufactured by Rogers Corporation under the trademark PORON. Although this material can be utilized, other types of in-step cushion materials such as neoprene sponge, vinyl sponge, sponge rubber, latex foam and solid viscoelastic may be used. The in-step cushion 59 provides an extra layer of impact absorption material while adding comfort to the safety boot 20. The in-step cushion 59 creates a soft, uniform surface adjacent to the wearer's foot by eliminating the bumps, ridges, and irregularities caused by other layers of the metatarsal guard 50 or the interior surface 32 of the upper 22.

Although the preferred embodiment of the present invention can include those materials described above, it would be obvious to one skilled in the art to either mix, delete, or add materials. For example, another embodiment of the metatarsal guard 50 may not include the impact cushion 52. Yet another embodiment may not include the in-step cushion 59. The metatarsal guard 50 without these layers is sufficiently flexible and comfortable to encourage daily use and would therefore work well with the invention. Furthermore, other embodiments of the present invention may include additional material layers between the inner lining 40 and the interior surface 32 of the upper. Any additional material layers will help absorb impact forces from falling or rolling objects; However, the addition of too many material layers may cause the safety boot 20 to appear bulky and heavier than the preferred embodiment of the present invention.

The sandwiched materials of the metatarsal guard 50 can be held closely adjacent to one another by an adhesive 74 applied to the opposing faces of the following layer of material. The adhesive 74 is placed onto the impact cushion 52 either directly or, alternately, in the form of a thin membrane covered on both sides with adhesive which is exposed by peeling off layers of release paper on both sides of the thin membrane to bind the impact cushion 52 to the segment of cut-resistant material 54. Another adhesive 75 affixes the segment of puncture-resistant material 54 to the segment of force absorption material 56.

The two segments of force absorption material 55 as shown in FIG. 3 are affixed by another adhesive 76. Finally, yet another adhesive 77 affixes the segment of force absorption material 56 to the in-step cushion material 59. The adhesives 74, 75, 76, and 77 prevent the layers of material forming the sandwich from shifting or moving during use once inside the void 42 near the in-step region 28 between the inner lining 40 and the interior 32 of the upper 22.

The adhesives 74, 75, 76, and 77 used can be a mixture of natural and synthetic rubbers modified with tackifying resins, pigments, filler, and antioxidants dissolved in hydrocarbon solvents. Although such adhesives are preferred, it would be obvious to one skilled in the art to use other adhesives such as double sided tape 76, glue, polysaccharide resins, or other adhesives that can be applied directly to the surface of each layer.

In other embodiments of the present invention, the separate layers of the metatarsal guard 50 may remain free with other means being used to retain the metatarsal guard 50 in place between the interior surface 32 and the inner lining 40. As shown by way of example in FIG. 4, stitching 72 can be used to join the inner lining 40 to the upper 22 to retain the metatarsal guard 50 within the void 42.

Although an exemplary embodiment of the metatarsal guard of the present invention has been shown and described with reference to particular embodiments and applications thereof, it will be apparent to those having ordinary skill in the art that a number of changes, modifications, or alterations to the invention as described herein may be made, none of which depart from the spirit or scope of the present invention. All such changes, modifications, and alterations should therefore be seen as being within the scope of the present invention.

What is claimed is:

1. A safety shoe or boot having improved protection for a wearer's foot metatarsal region, said safety shoe or boot comprising:

a sole having a top surface;

an upper having an interior surface, said upper being affixed to said sole, said upper and said sole defining a cavity therebetween for receiving the wearer's foot;

an inner lining located adjacent to at least a portion of said interior surface of said upper; and a flexible metatarsal guard adapted to flex and bend with the wearer's foot such that said metatarsal guard will not inhibit the wearer's full range of motion during natural walking and running movements, said metatarsal guard including a segment of a flexible, cut-resistant material, a segment of force absorption material, and a segment of in-step cushion material, wherein said segment of cut-resistant material, said segment of force absorption material, and said segment of in-step cushion material together comprise said flexible metatarsal guard, said metatarsal guard being interposed between said interior surface of said upper and said inner lining proximate to a metatarsal region of the wearer's foot when the wearer's foot is located in said cavity.

2. A safety shoe or boot as defined in claim 1, further comprising a rigid toe protector located close adjacent to said interior surface of said upper at an end thereof which will receive a wearer's toes when the wearer's foot is located in said cavity.

3. A safety shoe or boot as defined in claim 2, wherein a portion of said metatarsal guard overlays a portion of said rigid toe protector.

4. A safety shoe or boot as defined in claim 3, wherein a portion of said metatarsal guard is adhesively affixed to said rigid toe protector.

5. A safety shoe or boot as defined in claim 1, wherein said metatarsal guard is affixed to said inner lining.

6. A safety boot or shoe as defined in claim 5, wherein said metatarsal guard is affixed to said inner lining by adhesive tape.

7. A safety boot or shoe as defined in claim 1, further comprising stitching, said stitching joining said inner lining to said interior of said upper and surrounding said metatarsal guard to secure said metatarsal guard in place.

8. A safety shoe or boot as defined in claim 1, wherein said metatarsal guard further comprises a segment of impact cushion material.

9. A metatarsal guard safety boot or shoe as defined in claim 8, wherein said segment of impact cushion material comprises a polyethylene foam material.

10. A safety shoe or boot as defined in claim 8, wherein said metatarsal guard is a sandwich of each said segments, said sandwich having as consecutive layers from the outside to said cavity said segment of impact cushion material, said segment of cut-resistant material, said segment of force absorption material, and said segment of in-step cushion material.

11. A safety shoe or boot as defined in claim 10, wherein adhesive material is used to bind together adjacent segments in said sandwich of segments forming said metatarsal guard.

12. A safety shoe or boot as defined in claim 1, wherein said segment of force absorption material comprises a plurality of air pockets.

13. A safety shoe or boot as defined in claim 1, wherein said segment of force absorption material comprises two layers of a rubber material.

14. A safety shoe or boot as defined in claim 1, wherein said in-step cushion is a urethane foam.

15. A safety shoe or boot as defined in claim 1, wherein said segment of cut-resistant material is a light weight, flexible fabric of poly-paraphenylene terephthalamide fibers.

16. A flexible metatarsal guard for use in safety footwear, comprising:

a segment of impact cushion material;

a segment of a flexible, cut-resistant material; and a segment of force absorption material, wherein said segment of impact cushion material, said segment of cut-resistant material, and said segment of force absorption material are sandwiched together to form said flexible metatarsal guard said metatarsal guard adapted to flex and bend with the wearer's foot such that said metatarsal guard will not inhibit the wearer's full range of motion during natural walking and running movements.

17. A metatarsal guard as defined in claim 16, wherein said segment of force absorption material comprises a plurality of layers of rubber.

18. A metatarsal guard as defined in claim 16, further comprising a segment of in-step cushion material located close adjacent to said segment of force absorption material.

19. A metatarsal guard as defined in claim 16, wherein said segment of impact cushion material is secured to said segment of cut-resistant material by an adhesive material and said segment of force absorption material is secured to said segment of cut-resistant material by an adhesive material.

20. A metatarsal guard as defined in claim 16, wherein said segment of impact cushion comprises a polyethylene foam material.

21. A safety boot or shoe having improved protection for a wearer's foot metatarsal region, said safety boot comprising:

an upper having an interior and in-step region;

an inner lining affixed to said interior of said upper, said inner lining and said interior of said upper defining a void therebetween, said void being located proximate to said in-step region of said upper;

a sole having a top portion and a toe region, said upper being joined to said sole to define a cavity to accommodate the wearer's foot;

a rigid toe protector having a cap and sidewalls, said cap being located close adjacent to said interior of said upper, and said sidewalls in substantial abutment with said top surface of said toe region of said sole; and a flexible metatarsal guard affixed to said inner lining, said metatarsal guard adapted to flex and bend with the wearer's foot such that said metatarsal guard will not inhibit the wearer's full range of motion during natural walking and running movements, said metatarsal guard comprising:

a segment of impact cushion material;

a segment of a flexible, cut-resistant material;

a segment of force absorption material; and a segment of in-step cushion material, said segments of said metatarsal guard being superimposed upon one another with said segment of impact cushion material being adhesively affixed to segment of a flexible, cut-resistant material, said segment of force absorption material being adhesively affixed to said segment of a flexible, cut-resistant material, and said segment of force absorption material being adhesively affixed to said segment of in-step cushion material to form a flexible sandwich, said flexible sandwich being interposed between said interior of said upper and said inner lining in said void, a portion of said sandwich overlapping a portion of said cap of said rigid toe protector.

22. A safety boot or shoe as defined in claim 21, wherein said rigid toe protector is made of steel or hard polymer material.

23. A safety boot or shoe as defined in claim 21, wherein said in-step cushion is made of a urethane foam material.

24. A safety boot or shoe as defined in claim 21, wherein said force absorption material comprises a plurality of air pockets.

25. A safety boot or shoe as defined in claim 21, further comprising stitching, said stitching joining said inner lining to said interior of said upper to secure said guard in place.

26. A safety boot or shoe as defined in claim 21, wherein said metatarsal guard is affixed to said inner lining by an adhesive or stitching.

27. A safety boot or shoe as defined in claim 26, wherein said adhesive is adhesive tape.

28. A method of making a safety shoe or boot having improved protection for a wearer's foot metatarsal region, said method comprising the steps of:

attaching an inner lining to an upper, said inner lining and said upper defining a void therebetween;

joining said upper to a sole, said sole and said upper defining a cavity therebetween to accommodate the wearer's foot;

producing a flexible metatarsal guard adapted to flex and bend with the wearer's foot such that said metatarsal guard will not inhibit the wearer's full range of motion during natural walking and running movements, said metatarsal guard being produced by assembling the metatarsal guard in consecutive layer fashion, wherein said assembling comprises the steps of:

affixing a segment of impact cushion material to a segment of a flexible, cut-resistant material; and affixing a segment of force absorption material to said segment of cut-resistant material; and after said flexible metatarsal guard has been assembled, inserting said flexible metatarsal guard into said void intermediate said inner lining and said upper located superior the metatarsal region of the wearer's foot.

29. A method as defined in claim 28, further including affixing an in-step cushion material to said force absorption material prior to inserting said metatarsal guard into said void.

30. A method as defined in claim 28, wherein a rubber based adhesive affixes said impact cushion to said cut-resistant material.

31. A method as defined in claim 28, further comprising the step of stitching said upper and said inner lining together to retain said metatarsal guard within said void.

32. A method as defined in claim 28, wherein said segment of force absorption material comprises a plurality of layers of rubber.

33. A method as defined in claim 28, wherein said metatarsal guard is affixed to said inner lining by an adhesive.

34. A method as defined in claim 28, wherein said segment of cut-resistant material is a light weight, flexible fabric of poly-paraphenylene terephthalamide fibers.

* * * * *